US008375864B1

(12) United States Patent
Crawford et al.

(10) Patent No.: US 8,375,864 B1
(45) Date of Patent: Feb. 19, 2013

(54) FLOATING OMNIMOVER RIDE

(75) Inventors: David W. Crawford, Long Beach, CA (US); Edward A. Nemeth, Hermosa Beach, CA (US)

(73) Assignee: Disney Enterprises, Inc., Burbank, CA (US)

( * ) Notice: Subject to any disclaimer, the term of this patent is extended or adjusted under 35 U.S.C. 154(b) by 0 days.

(21) Appl. No.: 13/193,746

(22) Filed: Jul. 29, 2011

(51) Int. Cl.
*A63G 1/00* (2006.01)

(52) U.S. Cl. ..... 104/73; 104/53; 186/49; 472/117

(58) Field of Classification Search ..... 104/23.1, 104/23.2, 72, 73, 70, 59, 139, 154, 161, 60; 472/127, 128, 129
See application file for complete search history.

(56) References Cited

U.S. PATENT DOCUMENTS 1,440,661 A * 1/1923 Dickinson ..... 104/66
1,563,855 A * 12/1925 Held ..... 280/18
1,607,771 A * 11/1926 Miller ..... 104/63
2,064,035 A * 12/1936 Rynearson ..... 104/71
2,235,563 A * 3/1941 Ridgway ..... 104/73
3,003,430 A * 10/1961 Hamel ..... 104/72
3,113,528 A * 12/1963 Morgan et al. ..... 104/73
3,404,635 A * 10/1968 Bacon et al. ..... 104/70
3,929,076 A 12/1975 McRae, Jr. et al.
3,930,450 A * 1/1976 Symons ..... 104/73
4,063,517 A * 12/1977 Nardozzi, Jr. ..... 104/35
4,149,469 A * 4/1979 Bigler ..... 104/73
4,270,457 A 6/1981 Kerber
4,337,704 A * 7/1982 Becker et al. ..... 104/70
4,392,434 A * 7/1983 Durwald et al. ..... 104/70
4,583,479 A 4/1986 Lehmann
4,828,099 A 5/1989 Dexter, Jr.
5,011,134 A * 4/1991 Langford ..... 472/117
5,020,465 A 6/1991 Langford
5,299,964 A * 4/1994 Hopkins ..... 114/346
5,474,153 A * 12/1995 Iwamoto et al. ..... 186/49
5,558,198 A 9/1996 Juarez
5,564,984 A * 10/1996 Mirabella et al. ..... 472/43
5,613,443 A * 3/1997 Ariga et al. ..... 104/70
5,732,635 A 3/1998 McKoy
5,775,226 A * 7/1998 Futami et al. ..... 104/71
5,813,497 A * 9/1998 Iwamoto et al. ..... 186/49
5,823,296 A * 10/1998 Iwamoto et al. ..... 186/49
5,860,364 A 1/1999 McKoy
6,053,790 A * 4/2000 Langford ..... 441/129
(Continued)

FOREIGN PATENT DOCUMENTS

GB 25010 0/1902

*Primary Examiner* — Jason C Smith
(74) *Attorney, Agent, or Firm* — Marsh Fischmann & Breyfogle, LLP; Kent A. Lembke

(57) ABSTRACT

A floating omnimover ride with high capacity throughput and enhanced control over speeds of passenger boats. The ride includes a water containment structure with spaced apart sidewalls defining an elongated guide channel that defines a loop-shaped ride path or circuit. The ride includes a volume of liquid contained in the guide channel to a desired depth. The ride also includes a chain of passenger boats floating in the liquid contained in the guide channel. Each of the boats is linked to the two adjacent boats with a connecting link such that the chain of boats is a continuous loop. The chain of boats has a length that is approximately equal to a length of the ride path, and during operation of the ride, the boats in the chain are moved along the loop-shaped ride path at a predefined rate by a pump station moving the liquid in the guide channel.

18 Claims, 5 Drawing Sheets

U.S. PATENT DOCUMENTS

| | | | | |
|---|---|---|---|---|
| 6,170,403 | B1 * | 1/2001 | Behringer | 104/59 |
| 6,354,223 | B2 * | 3/2002 | McKoy | 104/72 |
| 6,553,915 | B2 * | 4/2003 | Tseng | 104/23.1 |
| 6,580,541 | B1 | 6/2003 | Yamashita et al. | |
| 6,860,209 | B2 * | 3/2005 | McKoy | 104/72 |
| 6,971,317 | B2 * | 12/2005 | McKoy | 104/72 |
| 7,437,998 | B2 * | 10/2008 | Burger et al. | 104/73 |
| 7,491,128 | B2 | 2/2009 | Henry et al. | |
| 7,784,405 | B2 * | 8/2010 | Rose et al. | 104/20 |
| 8,091,483 | B1 * | 1/2012 | Sumner | 104/73 |
| 8,197,352 | B2 * | 6/2012 | Henry et al. | 472/117 |
| 2006/0052171 | A1 * | 3/2006 | Henry et al. | 472/117 |
| 2006/0130698 | A1 * | 6/2006 | Burger et al. | 104/73 |
| 2006/0219124 | A1 * | 10/2006 | Jordan | 104/23.1 |

* cited by examiner

FLOATING OMNIMOVER RIDE

BACKGROUND

1. Field of the Description

The present invention relates, in general, to amusement park rides, and, more particularly, to a floating omnimover ride configured to provide high capacity rides with floating passenger vehicles or boats moving through the ride at a constant speed (or within a preset, accepted range of boat speeds) along a ride path.

2. Relevant Background

It is a goal of many amusement park operators to provide enjoyable rides but with high capacity and predictable pacing to facilitate providing show elements and entertainment to passing vehicles. With the goal of higher ride or attraction capacity in mind, omnimover rides have been utilized in many theme parks. An omnimover is a ride system that has been developed to provide an experience that is similar to a walk-through experience or ride-through tour as it moves guests at speeds similar to walking speed such as less than about 2 feet per second. The omnimover is a ride system used for theme park attractions such as haunted houses or movie-based theme attractions in which two, three, or more passengers sit in a vehicle that is towed or moved along a track. The omnimover ride system includes a large number of such vehicles that are each attached or linked into a continuous loop or chain. The vehicles are connected into a chain, and the vehicle chain moves along a track, with the track typically hidden beneath a floor.

The chain of vehicles is kept in continuous and predictable motion, typically at a constant speed, throughout the entire course of the attraction such as along an irregular path to move through the rooms of a house or set of a show or attraction. High throughput or increased daily capacity is achieved because the vehicle chain continues to move throughout the day, with riders loading and unloading while the vehicles are in motion. Standard loading and unloading occur with a next set of passengers standing on a loading belt, which is moving at about the chain/vehicle speed, and then entering adjacent vehicles. At a different location or station, passengers in vehicles exit their moving vehicle at the end of the ride to step onto an adjacent unloading belt, which is also moving at about the speed of the vehicle chain.

The omnimover ride system continues to provide a popular platform for rides in many amusement parks as the omnimover ride system effectively delivers high capacity with a simple mechanical drive and control system. However, many park operators continue to search for different and new rides, and it may be undesirable to simply add another conventional omnimover ride to a park as the ride experience may be very similar to existing attractions. Hence, there remains a need for a ride system that provides the high capacity or passenger throughput of a conventional omnimover ride but that also provides a new, unique, fun, and exciting or at least different ride experience. Preferably, such a ride system would enhance the variability of rides at an amusement park while preserving the benefits of conventional omnimover rides including high capacity, a continuous chain of vehicles, and a simple and/or well-known propulsion and control system for moving the vehicle chain.

SUMMARY

The inventors recognized that one potential way to create a new and very different omnimover ride would be to create a floating or water-based omnimover ride. With that concept or idea in mind, the present description describes a boat ride system (or omnimover water ride) that provides a high capacity ride with smaller boats (e.g., floating vehicles with 2 to 4 riders or the like) that move in an ongoing or continuous manner and substantially constant speeds. In this regard, the ride system may be thought of as a floating omnimover. Briefly, the ride system includes a collection of floating vehicles or boats attached to each other with a compliant connection (i.e., direct boat-to-boat connections or tethers that include at least one pivot point or are provided with a flexible element or tow "rope" such as a cable).

The vehicles are arranged and tethered together in a continuous loop or chain of vehicles that has a length that substantially matches the length of the path the vehicles travel in the ride system. Hence, the ride system is like a conventional omnimover in this regard, but it is unlike a conventional omnimover in that there is no track or track-mounted drive system propelling the boats. For propulsion, the chain of vehicles (or vehicle chain) is largely contained within an open channel or trough in which water, upon which the boats are floating, is pumped or caused to flow such that the water in the channels is flowing at a rate that carries the floating boats through the channel(s) at a desired and, typically, constant rate. The boats may have rollers/wheels or pads on their sides such that they may contact sidewalls defining the channel(s) or trough(s) such that the boats are guided along a ride path or circuit defined by the channel. For example, the width of the channel may be a small amount larger than the width of the boat hull (which may be increased to account for the pads or rollers/wheels that abut the sidewalls) such that the boats are guided along the ride path with less twisting or binding of the chain of vehicles.

In addition to the guide channel or trough, the ride system may also include an open bay or free-floating portion or section in which the boats are not guided by and do not contact nearby sidewalls. As long as a sufficient number of the floating vehicles are contained in and guided within the guide channel (or flowing or drive) portion or section of the ride system, other sections of the vehicle chain may be "undriven" by the water in the free-floating section or bay portion of the ride system. In this portion, the water may be relatively still or unflowing, but the boats in the vehicle chain will still follow a path between an exit of the guide channel and an entrance to the guide channel because they are pulled and/or pushed by the boats or vehicles traveling in the guide channel (where water is flowing to push the boats along the path between adjacent sidewalls). In the open bay or free-floating portion, the boats or vehicles may even be caused to traverse over land or out of the water by placing ramps in the path of the boats and providing pads or rollers/wheels on the bottom of the boat hulls/bodies. The pushing and pulling forces provided along the vehicle chain by the boats in the guide channel due to the flowing water will roll the boats in the open bay or free-floating portion over the dry or shallow portion of the ride. By including an open waterway in the ride system, the ride experience is enhanced as the boats appear to be magically guided and propelled through the still water with their boats spaced apart from guiding sidewalls.

More particularly, a boat ride is provided that is designed for high capacity throughput and enhanced control over the speed of floating passenger boats while still giving passengers a feeling of freely floating on water. The ride includes a structure (or water containment/basin) with spaced apart sidewalls that, along with a channel floor or bottom, define an elongated guide channel (e.g., an open flume with straight sections and with curves). The ride further includes a volume of liquid (e.g., water) contained in the guide channel, and the guide channel defines a loop-shaped ride path (or ride circuit).

Significantly, the ride also includes a chain of passenger boats floating in the liquid contained in the guide channel. Each of the boats is linked with a connecting link at a first side to a leading one of the boats and with a connecting link at an opposite second side to a trailing one of the boats. In this way, the chain of boats is a continuous loop or provides a vehicle chain of a particular length with its two ends interconnected. The chain of boats has a length that is approximately equal to a length of the loop-shaped ride path, e.g., within 5 to 20 feet depending upon the overall length of the ride path. During operation of the ride, each of the boats in the chain moves along the loop-shaped ride path at a predefined rate.

To this end, the boat ride may include a propulsion system connected to (or in fluid communication with) the guide channel. The propulsion system operates to move at least a portion of the liquid in the guide channel at one or more flow rates, e.g., a pumping station may have one-to-many outlets in the guide channel to create a flowing river of liquid in the guide channel. In this way, the chain of boats moves along the loop-shaped ride path at the predefined rate, which may be selected from a range of 1 to 4 feet per second. To guide the boats to travel down the ride path, the guide channel may have a width as measured between inner surfaces of the sidewalls that is greater than a width of each of the boats by less than a preset magnitude, which may be selected from the range of zero to a maximum one of the widths of the boats such that the boats periodically abut or contact the sidewalls to redirect their movement along a direction of travel in the guide channel.

The boat ride may include a wave generator along a section of the guide channel that selectively or continuously operates to form waves on a surface of the liquid in the guide channel section. The connecting links provide direct boat-to-boat connections, which each include at least one pivot point providing freedom of movement in at least two directions (e.g., side-to-side lateral movement/pivoting, up and down bobbing in the liquid, or the like) In some cases, the connecting links are formed with a ball coupler, a rigid tow bar, or a flexible tow bar.

in some embodiments, the sidewalls of the structure further define a free-floating portion in which the boats appear to be unguided by any structures, sidewalls, or a track. In this portion of the ride, the sidewalls are spaced apart a distance selected such that the vehicles travel through the free-floating portion free of abutting contact with the sidewalls (e.g., two or more times the width of the boats or the like). The liquid in the free-floating portion may be substantially still or unmoving, e.g., moves at a rate much less than a rate at which the liquid moves in the guide channel. In some cases, free-rolling or powered guide wheels are provided on inner surfaces of the sidewalls in the guide channel or are provided on sides of each of the vehicles to reduce friction when the vehicles are guided to travel along the loop-shaped ride path by the sidewalls.

In some embodiments, a unique ride is provided by designing the water containing structure to include at least one section in which the boats in the chain of boats travel out of the liquid and back into the liquid. The boats in this amphibious section are moved along the loop-shaped ride path by the boats in the liquid of the guide channel (e.g., the motive force for these dry land, rolling "boats" is provided by the vehicles in other sections of the vehicle chain that are being pushed along by flowing water).

DETAILED DESCRIPTION OF THE PREFERRED EMBODIMENTS

Figure 1:
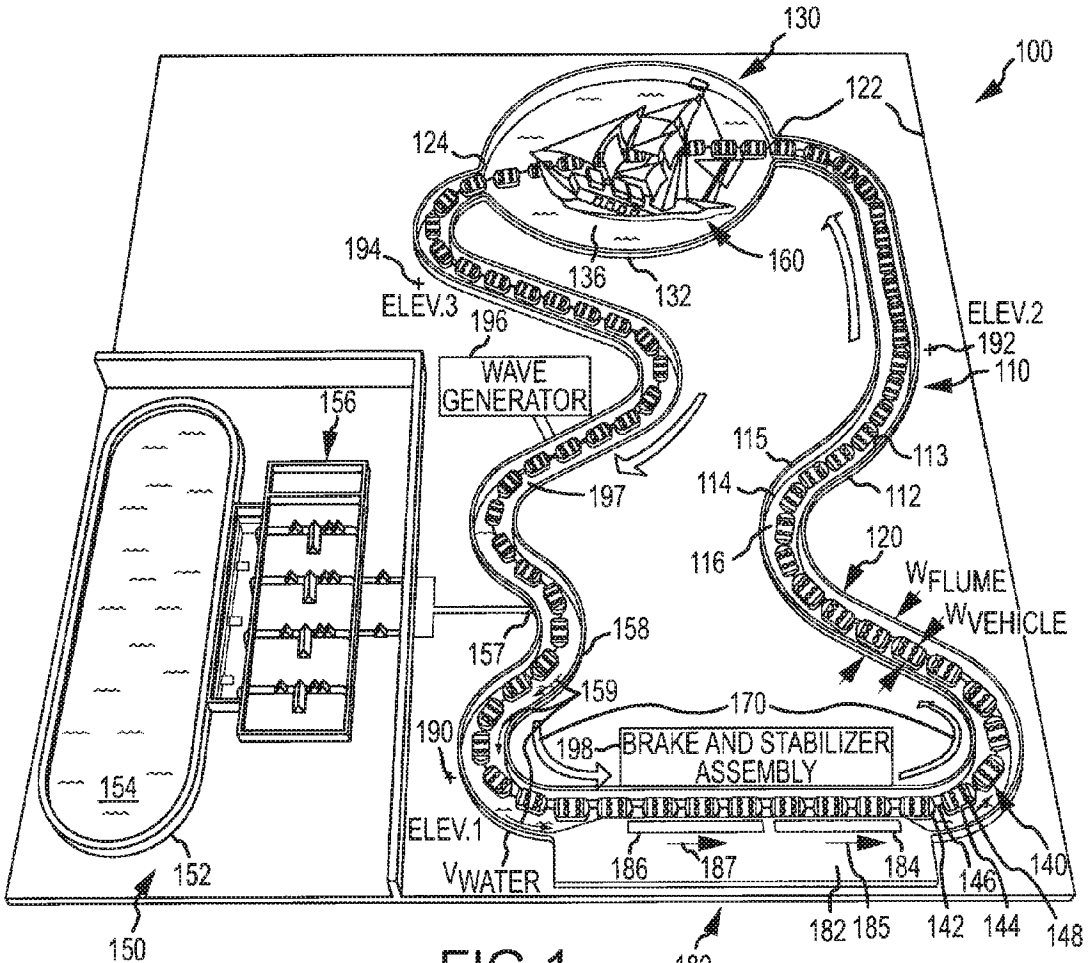
FIG. 1 is a perspective and schematic view of a floating omnimover ride according to one embodiment showing combination of a channel/flume with a free-floating or lagoon section to cause a chain of vehicles floating in water pumped through the channel/flume to move along a ride path or circuit with all vehicles traveling in a continuous manner at a relatively constant rate or speed (e.g., 1 to 3 fps or the like)

Briefly, embodiments of boat rides or ride systems (also called floating omnimovers or omnimover rides) include a structure or containment that has at least one guide channel and may include one or more free-floating or open bay portions. The structure is adapted to receive and hold a volume of water, and a propulsion system including one or more water pumps is provided with water outlets in the guide channel(s) to cause the water in these channels to flow at a desired rate (e.g., 0 to 4 feet per second (fps) or the like). The propulsion system (or pump assembly) may also include one or more wave generators to provide localized waves or "rough" water in lengths of the channel to provide interesting dynamics, thrill, and the illusion of moving more quickly even though the vehicle chain continues to move at a constant speed. A stabilizer and/or braking device may be provided in the propulsion system (such as in the station) to act as a pacer for the vehicle chain to provide tight control over the speed of the vehicles (e.g., tight control such as within 10 percent or the like of a set speed in the range of 1.5 to 2.5 fps or the like) and also to act to limit rocking/movement of boats during loading/unloading.

The guide channels are typically defined by a pair of sidewalls extending along the length of the channel and spaced apart a distance that is a small amount (such as 1 to 4 feet or like) larger than the width of the boats (or their contact surfaces/members used to engage the sidewall surfaces in a rolling manner, for example). The sidewalls may be somewhat submerged under the water level or may extend upward out of the water (e.g., 1 to 3 feet vertical extension or more)

The boat ride also includes a chain of vehicles or boats tethered together in a boat-to-boat (or end-to-end) manner, and the chain of vehicles has a length that matches a path ride or circuit length as measured along a length of the guide channel(s) and across any free-floating portion (between an inlet and an outlet to such open body of water). In other words, the chain of vehicles has a fixed or average length during the operation of the ride that is about equal to the length of the ride path or circuit through the water-containment structure. The water in the channel(s) and across the free-floating portion acts as the vertical support for the omnimover's vehicles (in the chain of vehicles) and sidewalls in the channel combined with pushing/pulling forces applied by vehicles in the channel on the "free-floating" vehicles act as the guide for the vehicles. Hence, the water along with the structure acts to define the "track" of the floating omnimover ride, and the flowing water provides the drive or propulsion system for the floating omnimover ride as the water applies a force on all of the vehicles as they move through the flowing water portion of the ride in the guide channels or troughs (or flumes). The vehicles typically move through the ride at a continuous (or even relatively constant) speed selected to be low enough to allow load/unloading with the vehicles/boats floating past a loading/unloading station (with or without a matching/pacing conveyor belt or turntable as is common in conventional omnimover rides).

The tether or link assembly between each pair of adjacent vehicles/boats may be considered a tow bar for directly linking boats together (such that vehicles form links in a vehicle chain and there is no need for a separate connection assembly such as a track-mounted drive system). This tow bar may include a flexible member in some cases to allow the vehicles to pivot and move relative to each other but still allow the leading vehicle in the pair to apply a tensile or pulling force. In many cases, though, it may be desirable for the tow bar to be formed of one or more rigid members/elements with one or more pivotal connections or connectors. This arrangement for the tether assembly provides a more rigid boat-to-boat linkage that maintains a desired overall length of the vehicle chain and also acts to keep boats spaced apart some minimum distance (to avoid bumping into each other).

FIG. 1 illustrates a water-based ride system (or floating omnimover ride) 100 that is adapted to provide and combine the beneficial characteristics of a conventional track-based and driven omnimover with the unique feeling of being on a boat. As shown, the omnimover ride 100 includes a water containment structure 110 for defining a water-based ride path that includes vehicle drive portions or sections in which vehicles are guided to travel along a predefined path or circuit and also includes free-floating portions or sections (e.g., lagoons or bays) in which the vehicles/boats appear to float in an unguided manner.

In the illustrated ride 100, the structure 110 is configured to define an elongated and open channel or flume 120 and to define a free-floating portion or lagoon/bay 130. The channel or flume 120 is provided by a first sidewall 112 and a second sidewall 114 that are both extending upward a distance (e.g., a sidewall height defining a maximum depth of any received water) from a channel floor or bottom 116. The sidewalls 112, 114 are spaced apart a distance defining a width, $W_{Flume}$, of the channel/flume 120, with the distance being measured between facing inner surfaces or sides 113, 115 of the sidewalls 112, 114. The sides 113, 115 act as guide or contact surfaces for vehicles 142, 144, and the flume width, may be only a small amount or magnitude greater (e.g., several inches up to several feet but typically less than about half the width, $W_{Vehicle}$, such that the vehicle 142, 144 cannot turn excessively from the direction of travel and/or bind with adjacent vehicles when floating in the channel 120) than the vehicle width, $W_{Vehicle}$ (as measured from an outer perimeter of the vehicle body/boat hull or its contact surfaces or components such as hull-mounted wheels/rollers or pads provided to reduce friction upon sidewall-to-vehicle contact). As a vehicle 142, 144 travels along the channel 120 the sidewalls 112, 114 act to guide it to follow along a ride path or circuit for the ride 100.

The first and second sidewalls 112, 114 expand outward to provide an outer sidewall 132 of the lagoon or free-floating portion 130 of the ride 100. To this end, the guide channel 120 has an inlet 122 to the free-floating portion 130 and also an outlet 124 from the free-floating portion 130, and the inlet 122 and outlet 124 are typically the width or somewhat larger in size than the guide channel 120 to provide access for the vehicles 142, 144 to the free-floating portion 130 and back into the guide channel 120. As shown, the free-floating portion 130 differs from the guide channel 120 in that its sidewalls 132 extend upward from a pool/lagoon floor or bottom and define a perimeter or circumference that is relatively large such that the vehicles 142, 144 are spaced apart a relatively large distance from at least a left or right sidewall 132.

In this way, the vehicles 142, 144 appear to be free-floating or unguided through the lagoon/pool 130. The vehicles 142, 144 do not come into contact with the sidewalls 132 in contrast to when they are in the guide channel 120 and may contact sides/surfaces 113, 115 of sidewalls 112, 114 so as to be guided down the ride path or circuit of ride 100. A show element 136 may be provided between the sidewalls 132 and the vehicles 142, 144 may float past the show element 136 between the inlet and outlet 122, 124, e.g., the ride path or circuit is generally along the center line of the guide channel 120 and across the lagoon/free-floating portion in a line drawn between the inlet 122 and outlet 124.

The floating omnimover ride 100 includes a chain of vehicles or boats (or vehicle chain) 140. The vehicle chain 140 is made up of a plurality or large number of vehicles (or boats) 142, 144 adapted for seating or supporting 1 to 4 or more passengers 148. The ride 100 is a water ride, and each of the vehicles 142, 144 is adapted for floating on or in water 158 that is used to fill (or partially fill) the channel 120 and lagoon/free-floating portion 130. The "chain" is formed by interconnecting each adjacent pair of vehicles (e.g., the vehicles are the "links" of the vehicle chain 140). To this end, adjacent vehicles 142, 144 are shown to be linked together with a connecting link or coupling assembly (or member) 146.

As will be explained below, the connecting link 146 is configured to attach the front or forward end of the trailing vehicle 142 to the back or rear end of the leading vehicle 144, and it is adapted to provide at least one pivot point such that the vehicles 142, 144 can move separately from each other (e.g., pivot about their central axis, rock/tip with waves on water 158, and so on as expected of a floating boat). The link 146 provides a direct boat-to-boat (or vehicle 142 to vehicle 144 or front-to-back) connection, which is in contrast to prior boat rides in which boats may be driven or pulled via a drive or drive member running below the boats in the water. This direct connection is preferred to provide a more simple drive and tighter control over movement of the vehicles 142, 144 (e.g., continuous speed and guided movement along ride path) while still providing floating experience.

The ride 100 has a circuit or ride path that extends generally along the center of the channel, trough, or flume 120 and in a line across the lagoon or free-floating portion 130. In other words, the ride path has a particular length as measured along the channel 120 and across the lagoon 130. The vehicle chain 140 is adapted so as to have a length that is substantially equal to the length of this ride path or circuit of ride 100. Too short of a vehicle chain 140 can result in binding on corners or inner surfaces while too long of a vehicle chain 140 can result in binding on outer surfaces of the channel 120.

In the floating omnimover ride 100, a propulsion system or assembly 150 is provided to both float the vehicle chain 140 and to cause it to move along the ride path of ride. The propulsion system 150 includes a reservoir (or water source) 152 that is filled with a volume of source water 154, with water 154 being used to drive the vehicle chain 140 and then drained and/or pumped back into the reservoir 152 for reuse with some make up water used to allow for losses (such as from evaporation and the like). A pump station (or one or more pumps) 156 is used to pump the water 154 to an outlet 157 to one or more locations along the guide channel 120. This causes the channel 120 and lagoon 130 to have a desired volume of water 158 and a desired water level/surface, which may be below heights of the sidewalls 112, 114, 132 or over to hide these walls/guide surfaces 113, 115.

More significantly, the pumping of water 154 into channel water 158 causes the water 158 to flow at a particular rate or speed, $V_{Water}$, as shown by arrows 159. The flowing 159 water 158 in guide channel 120 applies forces on the floating boats/vehicles 142, 144 of vehicle chain 140. This causes the vehicles 142, 144 to move along the guide channel 120 at a particular rate or speed, $V_{Chain}$, that may match or be similar to the water velocity. $V_{Water}$, in the channel 120. As shown with arrows 170, the forces applied by the water 158 on the individual vehicles 142, 144 in guide channel 120 causes the entire vehicle chain 140 to move at the same speed, $V_{Chain}$, as the adjacent vehicles 142, 144 apply pushing and pulling forces on each other via the direct boat-to-boat connecting link 146.

Hence, the flowing 159 water 158 causes the vehicles 142, 144 of vehicle chain 140 in the guide channel 120 to move along the channel 120 and its defined ride path or circuit, which may have straightaways and curves as shown. The vehicles 142, 144 are guided by sidewalls 112, 114 in the guided channel or flume 120. When the vehicles 142, 144 enter the lagoon or free-floating portion 130, though, the vehicles 142 144 are unguided or spaced apart from sidewall 132. However, the portion or length of the vehicle chain 140 (or subset of the vehicles 142, 144) within the guide channel 120 apply pulling/towing and pushing forces on the portion or length of the vehicle chain 140 (or subset of the vehicles 142, 144) floating "freely" in the lagoon or pool 160. In this manner, the free-floating vehicles 142, 144 of vehicle chain 140 are caused to travel from the lagoon inlet 122 to the lagoon outlet 124 so as to re-enter the guide channel or flume 120. These vehicles 142, 144 in lagoon 130 float across the still water 160 at the same rate as the other vehicles 142, 144 in the guide channel 140 (or at the speed or rate, $V_{Chain}$, such as 1 to 4 fps or the like). In this manner, the ride 100 moves all the floating vehicles 142, 144 of the chain 140 at a single rate, $V_{Chain}$, which is typically held substantially constant (e.g., a speed similar to other conventional omnimovers such as a rate selected from the range of 1.5 to 2.5 fps) by selective operation of the propulsion system 150 to move 159 water 158 in the guide channel 120.

The ride 100 may be made more unpredictable and interesting by providing one or more wave generators 196. The wave generator 196 is used to form a waved surface 197 in the water 158 in a length of the channel 120 or in all or a portion of the lagoon 130, and the waved surface 197 causes the boats 142, 144 to rock and to provide sensations of moving faster or at least differently than other portions of the ride 100. The ride 100 may also include stretches such as in the lagoon 130 in which the vehicles 142, 144 of the chain 140 are caused to travel over land such as up and down a ramp to leave the water 158 (or enter a shallower portion of such water 158). The boats 142, 144 may have wheels/rollers on the bottom of the hulls/bodies to facilitate movement on "dry" land, and the pushing/pulling of boats/vehicles 142, 144 in the vehicle chain 140 that are being pushed by the flow 159 of channel water 158 is designed to be adequate to support such amphibious movement of a subset of the vehicles 142, 144 (e.g., enough boats 142, 144 have to be in the water 158 and moving along at the chain velocity, $V_{Chain}$, to tow or push the rolling boats 142, 144 over ramps or dry stretches of the ride 100).

The channel 120 and lagoon/free-floating portion 130 may be all at the same elevation such that the vehicle chain 140 moves through the ride 100 on a substantially planar surface of water 158, 160 (except for waved surfaces 197). In this case, the elevations 190, 192, 194 for the ride path would all be about equivalent. However, in other embodiments of ride 100, it may be desirable for there to be inclined and declined portions to add interest and/or unpredictability to the ride 100. In such cases, the elevation 190 may be less than a second elevation 192, which may be the same or different from a third elevation 194. The pushing and pulling of the vehicles 142, 144 on each other via the boat-to-boat connecting link 146 continues to move 170 the chain 140 at a single velocity or rate, $V_{Chain}$. For example, it may be desirable for elevation 194 to be greater than elevation 190 such that the channel or flume 120 near wave generator 196 provides (by combining an elevation drop and waves in surface 197) the sensation of a river rapids, even though the vehicle chain 140 continues to move 170 at the same velocity, $V_{Chain}$. It should be understood that the use of "same speed or velocity" is meant to denote the speed between the vehicles relative to each other. Vehicle speed measured from a fixed point through the flume may change slightly based on overall passenger loading, friction, and other factors, but, since all the vehicles are connected, they all will move at the same speed, even if this speed is changing somewhat during ride operations.

The ride 100 is also shown to include a station 180 with a platform 182 adjacent a length of the guide channel or open flume 120. The station 180 is adapted for loading and unloading passengers 148 to and from the vehicles 142, 144 of vehicle chain 140. To this end, a moving load belt, turntable, or walkway 184 may be provided that moves 185 along the DOT of the vehicle chain 140 in the channel 120 at about the same speed as the vehicle chain 140, e.g., at a rate matching $V_{Chain}$. Likewise, the station 180 includes a moving unload belt, turntable, or walkway 186 on the platform 182 that moves 187 along the DOT of the vehicle chain 140 in channel 120 at rate matching the chain velocity, $V_{Chain}$, to allow passengers 148 to exit the vehicles 142, 144 without requiring the vehicle chain 140 be stopped or even slowed. A brake and/or stabilizing assembly 198 may be provided near the station 180 to stabilize the vehicles 142, 144, which may be relatively small and prone to rocking/tipping without such stabilization, during loading and unloading (see FIG. 5 below).

Further, the assembly 198 may include a braking mechanism for halting (or at least resisting) movement of the vehicle chain 140 such as in the case of an emergency (e.g., a passenger 148 or object slips or falls into water 158 in channel 120 or lagoon 130) or for other operational reasons. The braking mechanism may act to capture (such as by contact with the bottom of the vehicle or by a fin or blade extending outward from the bottom of the hulls/bodies of the vehicles 142, 144) one or more of the vehicles 142, 144, which will cause the entire chain 140 to be captured/stopped.

As discussed above, one aspect of the floating omnimover rides described herein is that adjacent boats or vehicles are directly connected with a front-to-back (or back-to-front) connecting link. All the vehicles are coupled in this manner to form a continuous loop or chain of the interconnected vehicles. In this way, a vehicle acts to transmit a pulling and pushing force upon its trailing and its leading vehicles, respectively, as flowing/pumped water applies forces upon its body or hull. Since the vehicles are connected in this continuous loop or chain and because a large percentage/fraction (such as one third to one half or more) is positioned within a guide channel or flume in the ride/track-defining structure, the entire chain of vehicles moves at a single rate or velocity such as 1 to 4 fps (with 1.5 to 2.5 fps being useful in many applications). The connecting link may take a variety of forms to chain/link the vehicles directly together so as to allow for expected and desired relative motion between adjacent vehicles (e.g., want some independent movement upon the water of the ride).

Figure 2:
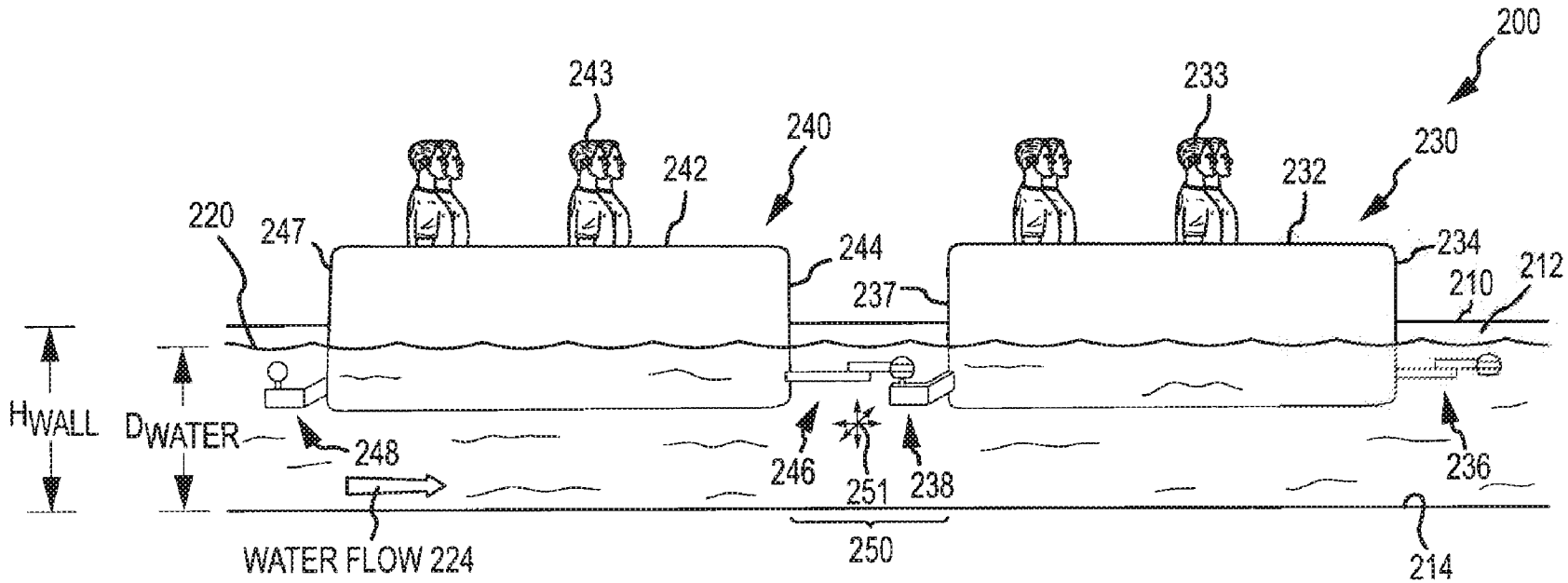
FIG. 2 illustrates a side sectional view (e.g., down the channel/flume with a near sidewall removed or cutaway) of a portion of a floating omnimover ride showing a pair of adjacent and tethered/connected vehicles to form a chain of vehicles using a ball coupler-type pivotal connection assembly between boats/vehicles.
Figure 3:
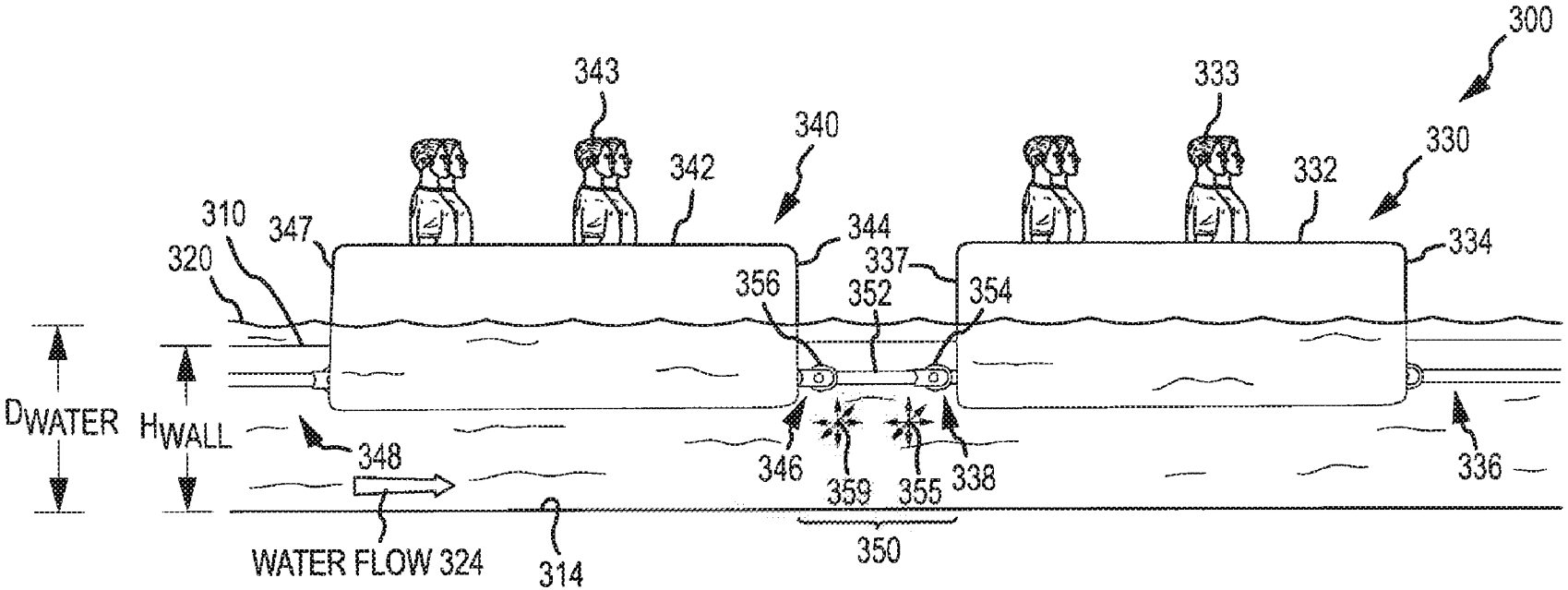
FIG. 3 illustrates another side sectional view, similar to FIG. 2, of another floating omnimover ride showing use of a tow bar arrangement to couple adjacent boats or vehicles to form a chain of vehicles with universal-type joints between vehicles and towbars.
Figure 4:
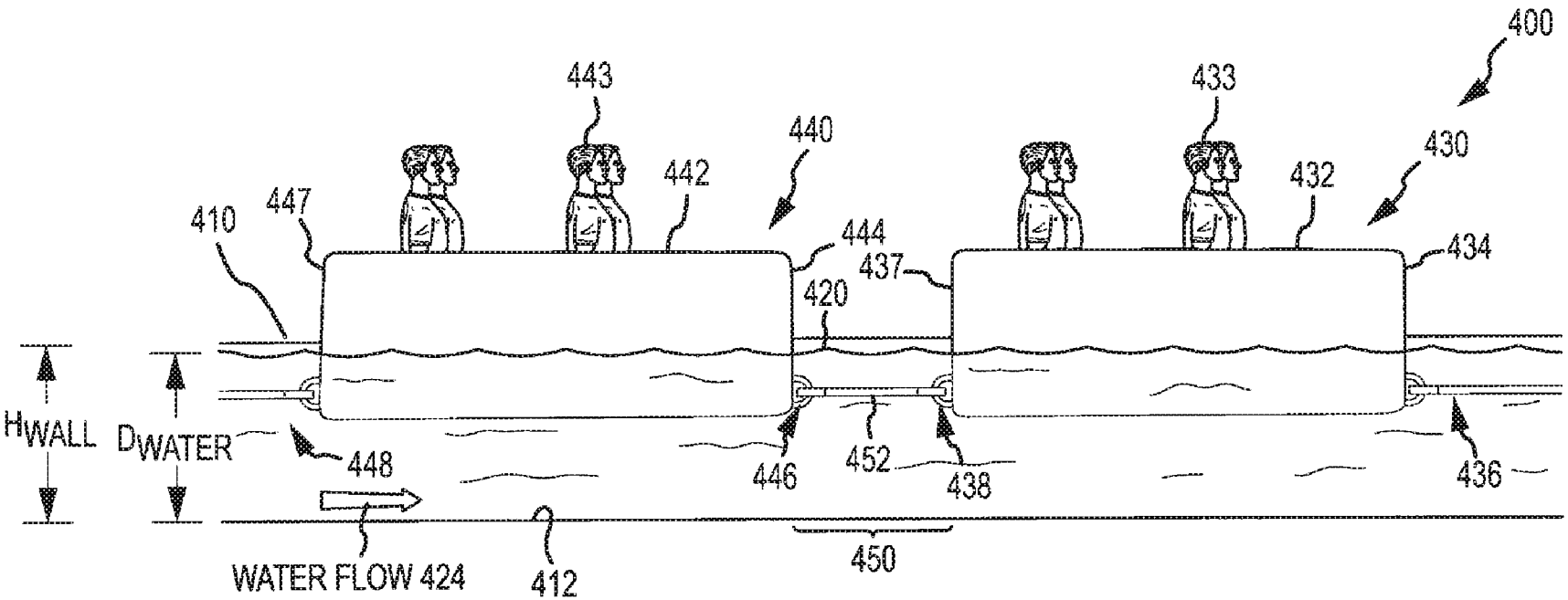
FIG. 4 illustrates, similar to FIGS. 2 and 3, a partial side view of a floating omnimover ride utilizing a flexible tow bar or connector to pivotally couple an adjacent pair of vehicles/boats to form a vehicle chain.

With this in mind, FIGS. 2-4 illustrates three useful connecting links that may be used to form a vehicle chain in a floating omnimover ride. FIG. 2 illustrates a portion of a ride 200 in which a first/leading vehicle 230 and a second/trailing vehicle 240 are floating on water 220 as the water 220 is caused to flow 224 at a particular flow rate. The water 220 is contained in a guide channel or open flume defined by a sidewall 210 and its inner surfaces or sides 212 (a second surface cut away in the sectional view of FIG. 2) and base or floor 214. The water 220 is shown to have a depth, $d_{Water}$, that is less than the height, $H_{Wall}$, of the sidewall 210.

The boats or vehicles 230, 240 each include a body or hull 232, 242 that is adapted to be buoyant or float on water 220 and to receive and, typically, seat passengers 233, 243 (such as 1 to 4 as shown or more). The hulls 232, 242 include a forward surface or side 234, 244 and a rear surface or side 237, 247, and, in each pair of vehicles such as vehicles 230, 240, the front or forward side 244 of the second/trailing vehicle 240 faces and is proximate to the back or rear side 237 of the first/leading vehicle 230.

To provide direct front-to-back or vehicle-to-vehicle pivotal connection, the ride 200 utilizes a connecting link 250 that takes the form of a ball coupler. In this regard, each boat or vehicle 230, 240 includes a ball or male connector 238, 248 (e.g., one or more rigid arms or plates extending outward from the hull 230, 240 upon which a ball or similar shaped-object is attached) on one of its front or rear sides 234, 244 or 237, 247, with FIG. 2 showing the ball connectors 238, 248 on the rear sides 237, 247. The boats or vehicles 230, 240 also include a socket or female connector 236, 246 (e.g., one or more rigid arms or plates extending outward from the hull 230, 240 upon which a socket or female connector is provide for receiving the ball of the other connector element) on the other one of the front or rear sides, with FIG. 2 showing socket connector 236, 246 on the front sides 234, 244 of the boat hulls 232, 242.

When the adjacent or each pair of boats 230, 240 are linked together with the connecting link 250, the boat hulls 232, 242 have a pivotal connection or a pivoting connection as shown with arrows 251 when floating and moving with water 220 as shown by water flow 224. In other words, the trailing boat 240 may pivot within a horizontal plane about the ball/socket connection (or an axis passing through the ball on element 238) and may also pivot up and down some amount to "bob" on the water 220 to provide a more true floating sensation for passengers 243.

FIG. 3 illustrates a portion of a ride 300 in which a first/leading vehicle 330 and a second/trailing vehicle 340 are floating on water 320 as the water 320 is caused to flow 324 at a particular flow rate. The water 320 is contained in a guide channel or open flume defined by a sidewall 310 and its inner surfaces or sides 312 (a second surface cut away in the sectional view of or about equal to the height, $H_{Wall}$, of the sidewall 310 such that the sidewall used to guide the boats/vehicles 330, 340 are submerged or hidden by the water 320.

The boats or vehicles 330, 340 each include a body or hull 332, 342 that is adapted to be buoyant or float on water 320 and to receive and, typically, seat passengers 333, 343 (such as 1 to 4 as shown or more). The hulls 332, 342 include a forward surface or side 334, 344 and a rear surface or side 337, 347, and, in each pair of vehicles such as vehicles 330, 340, the front or forward side 344 of the second/trailing vehicle 340 faces and is proximate to the back or rear side 337 of the first/leading vehicle 330.

To provide direct front-to-back or vehicle-to-vehicle pivotal connection, the ride 300 utilizes a connecting link 350 that takes the form of a tow bar. In this regard, each boat or vehicle 330, 340 includes a first pivotal connector 336, 346 on its front side 334, 344 and a second pivotal connector 338, 348 on its back or rear side 337, 347. The connecting link 350 also includes a rigid beam or bar ("tow bar") 352 that extends a distance (such as 0.5 to 3 feet or more) that defines vehicle separation distance that is maintained throughout the ride and along the vehicle chain in ride 300. The tow bar 352 is a rigid element (e.g., with a circular, square, or other useful cross sectional shape) made of stainless steel or some other strong but corrosion resistant or protected material. A pin (or pins) 354, 356 or other component(s) may be used to pivotally connect each end of the tow bar 352 to paired ones of the first and second pivotal connectors such as connectors 338, 346 of boats 330, 340 to allow pivotal movements 355, 357 (e.g., about one axis for side-to-side pivoting or, more preferably, two axes to also allow up and downward pivoting to allow independent bobbing or vertical movements in water 320).

FIG. 4 illustrates a portion of a ride 400 in which a first/leading vehicle 430 and a second/trailing vehicle 440 are floating on water 420 as the water 420 is caused to flow 424 at a particular flow rate. The water 420 is contained in a guide channel or open flume defined by a sidewall 410 and its inner surfaces or sides 412 (a second surface cut away in the sectional view of FIG. 4) and base or floor 414. The water 420 is shown to have a depth, $d_{Water}$, that is less than the height, $H_{Wall}$, of the sidewall 410.

The boats or vehicles 430, 440 each include a body or hull 432, 442 that is adapted to be buoyant or float on water 420 and to receive and, typically, seat passengers 433, 443 (such as 1 to 4 as shown or more). The hulls 432, 442 include a forward surface or side 434, 444 and a rear surface or side 437, 447, and, in each pair of vehicles such as vehicles 430, 440, the front or forward side 444 of the second/trailing vehicle 440 faces and is proximate to the back or rear side 437 of the first/leading vehicle 430.

To provide direct front-to-back or vehicle-to-vehicle pivotal connection, the ride 400 utilizes a connecting link 450 that takes the form of a flexible tow "bar." In this regard, each boat or vehicle 430, 440 includes a first connector 436, 446 (e.g., one or more loops or similar elements extending outward from the hull 230, 240) on its front side 434, 444. The boats or vehicles 430, 440 also include a second connector 438, 448 (e.g., another one or more of the loops or similar elements extending outward from the hull 230, 240) on the rear side 437, 447 of the boat hulls 432, 442. The connecting link 450 is completed by providing a flexible tow bar or flexible member 452 that is attached at its ends to paired first and second connectors 446, 438 of paired boats 440, 430. The flexible to bar 452 may have a length of several inches to several feet (or more in some cases), and it may take the form of a chain, a cable, a wire or other rope, or the like that may or may not be resilient but typically is chosen for its tensile strength.

When the adjacent or each pair of boats 430, 440 are linked together with the connecting link 450, the boat hulls 432, 442 have a pivotal connection or a pivoting connection as shown with arrows 458 and 459 when floating and moving with water 420 as shown by water flow 424. In other words, the trailing boat 440 is pulled along by the leading boat 430 via the flexible tow bar 450 via the connecting link 450, but the trailing boat 440 may pivot and move 459 in nearly any direction on the water 420 to provide a more true floating sensation for passengers 443. Such towing or pulling and also pivoting and bobbing occurs for each vehicle 430, 440 of the entire vehicle chain of the ride 400 as all the vehicles are interconnected with such flexible tow bars, and these differ from the other connecting links, such as link 350, as no pushing forces are applied.

As discussed above, vehicles or boats may be stabilized in a station for passenger loading and unloading. There are many ways to accomplish this function if it is desired useful for a floating omnimover ride such as ones with smaller vehicles that may be more likely to tip or move with passenger movements (e.g., a smaller boat made for two to four passengers or the like). For example, side and bottom rollers or conveyors could be provided in the station along the load and unload conveyor belts, and these could be free rolling or powered to provide positioning and stabilization of the passing vehicles/boats of a vehicle chain during loading and unloading. In some cases, these may be powered so as to provide speed pacing and braking resistance if and when the vehicle chain needs to be brought to a stop (in a more prompt manner than provided by stopping water flow).

Figure 5:
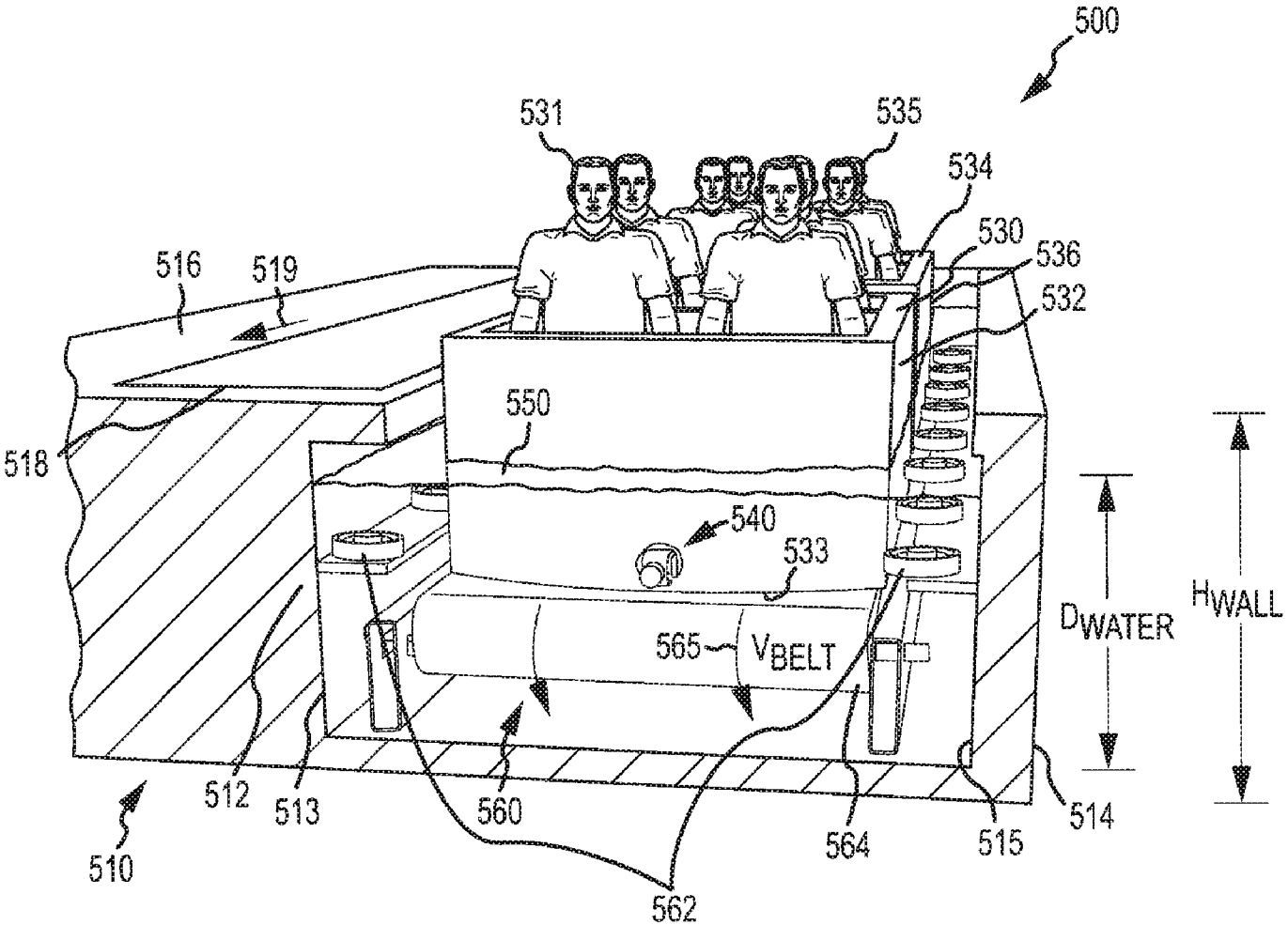
FIG. 5 is an end sectional view of a floating omnimover ride near the load/unload station showing on exemplary, but non-limiting, stabilizer assembly for assisting the loading and unloading of the floating vehicles/boats in a safe and predictable manner.

FIG. 5 illustrates a portion of a floating omnimover ride 500 in a sectional view in or near the station used for passenger loading/unloading. The ride 500 includes a structure or containment 510 with vertical sidewalls 512, 514 spaced apart a distance (channel width). The inner surfaces or sides 513, 515 along with the structure floor or base 517 define an open flume or guide channel in which a volume of water 550 is provided, with its surface below the upper edges of the sidewalls 512, 514 (which would typically be the case in the station portion of ride 500 with $d_{Water}$ less than $H_{Wall}$), and the water 550 would be caused to flow with a propulsion system with a pump station or the like in the channel or flume to move a chain of vehicles of the ride 500.

To this end, the ride 500 includes a plurality of vehicles 530, 534 in which passengers 531, 535 may be loaded (and later unloaded) via a load/unload belt 518 provided on platform 518 on the top of sidewall 512. The belt 518 may move as shown with arrow 519 along the channel at a rate, such as a rate in the range of 1 to 4 fps, and direction that are matched to the rate at which the water 550 and floating vehicles 530, 534 move in the channel/flume defined by sidewalls 512, 514 and floor 517. The vehicles 530, 534 are linked together into a chain with connecting links 540 that may take any of the forms shown above with reference to FIGS. 2-4 (or another design) that provides a connection with one or more pivot points.

A stabilization assembly 560 is provided to control up and down and side-to-side (and tipping/rocking) movement of the vehicles 530, 534. To limit side-to-side movement, the assembly 560 may include a plurality of rollers (or one or more conveyors) as shown with side guide wheels 562 provide to contact the sides 532, 536 of the vehicles 530, 534 (or their bodies/hulls). The guide wheels 562 may be free rolling and provided on one or more sides/surfaces 513, 515 of sidewalls 512, 514. In other embodiments, the vehicles 530, 534 may have side guide wheels, and the channel defined by sidewalls 512, 514 may be narrowed to cause a rolling and contact on both sides 532, 536 of the vehicles 530, 534 to provide desired vehicle positioning and stabilization (no or very limited side-to-side movement of the vehicles 530, 534 within the channel or flume).

To provide vertical stabilization of vehicles 530, 534, the stabilization assembly 560 includes a conveyor belt 564 moving as shown with arrows 565 (freely or under power to provide braking (or pacing)) on rollers. The conveyor belt 564 is positioned vertically within the channel between surfaces 513, 515 of sidewalls 512, 514 such that while in the station the bottom surface or side 533 of the boat/vehicle 530 may ride on or contact the belt 564. In such an arrangement, the boat 530 would not be floating near the load/unload belt 518 but would actually be riding on the belt 564 between side guide wheels 562.

In some cases, though, the belt 564 may be positioned a distance below the bottom side 533 of a boat hull at least for some loading amount and then the side 533 may contact the belt 564 upon some loading amount (or vertical movement). For example, the boat bottom 533 may be spaced apart from the belt 564 when the boat 530 has no or one or two passengers 531 (or some amount of weight), but the bottom 533 may contact the belt 564 to limit downward vertical travel to a preset amount (such 1 to 3 inches or more) during loading (and unloading it would move upward). This would provide the feeling of loading/unloading a floating boat while limiting movement to enhance safety for passengers 531. Then, when the vehicles 530, 534 are loaded with passengers 531, 535, the vehicles 530, 534 would continue travel along the ride path associated with or defined by the channel or open flume and roll off of the belt 564 and away from the side guide wheels 562 for a more free-floating ride experience in ride 500.

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed.

The above description teaches a floating omnimover ride system that includes a plurality of floating passenger vehicles or boats. The boats are linked together into a continuous chain in a direct manner with each pair of adjacent boats tethered together by a connecting link or tow bar. The connecting link may include rigid or flexible components but typically will include at least one pivotal connection such that the vehicles can move at least partially independently from each other (e.g., independent vehicle motion while being retained in the chain of vehicles). The ride system also includes an open channel or flume providing a stream or volume of flowing water, and the vehicles in the chain of vehicles are contained or guided within the channel as they float upon and are driven by the flowing water. To this end, the ride system includes a pumping system capable of pushing the water in the open channel such that it moves the vehicle chain at a constant speed, such as at a speed selected from the range of 1 to 4 fps, around the ride path defined by the open channel (or its sidewalls). The ride system also includes a station along the open channel or flume where passengers may load and unload from the moving boats/vehicles (without requiring stoppage).

In the ride system, the open channel (and the level of the water in the channel) may be provided in a planar arrangement such that the water level or upper surface is at a substantially constant elevation. In some embodiments, though, the open channel or flume and its water stream may be at multiple elevations connected by inclined and declined ramp sections. The water containment structure may include a free-floating portion that defines with sidewalls or the like a large pool or bay into which the water flume may empty to provide a larger volume of still water. The channel may include an outlet that empties the flowing water and chain of vehicles into this free-floating portion and an inlet back into the channel or flume through which the chain of vehicles is guided or forced to travel by vehicles in the channel portion being acted upon by water from the pumping system.

In practice, the walls of the open channel may extend above the water line or level or the walls may be "flooded" and below the surface of the water. In some cases, waves may be created by a wave generator on the water surface throughout the ride or in localized areas to induce vehicle rocking or other exciting and unexpected vehicle motions (e.g., to provide an experience that tends to hide the constant rate or speed of the boats along the channel and through the free-floating portion). A stabilizer assembly may be provided in the station to hold the moving vehicles more stable to limit rocking/tipping during loading and unloading. A braking system may be provided to hold the vehicles stationary during portions of normal operation or to allow emergency stoppage of the vehicle chain.

In some embodiments, free-rolling or powered guide wheels may be mounted on channel sidewalls or on the boat hull/body to reduce friction between the boat and channel sidewalls. The seating compartment of the boat may be able to spin or rotate relative to the outer hull or shell of the boat's hull/body contacting the water to allow differing movement of adjacent vehicles (or their passengers) in a free or powered manner (under passenger control, system control, or based on simple system dynamics).

The floating omnimover ride described herein provides a relatively simple ride system to implement and use in a theme, water, or amusement park environment. The only powered and controlled elements may be the water pumps of the propulsion system used to move the water in the open channel. The ride delivers high attraction capacity, eliminates the vehicle-to-vehicle collisions that are typical in most boat rides, and allows use of small and/or intimate vehicles/boats desired in many boat ride applications. The ride also delivers the feeling and dynamics of floating on water.

We claim:

1. A boat ride with high capacity and enhanced spacing control of floating passenger boats, comprising:

a structure with spaced apart sidewalls defining an elongated guide channel;

a volume of liquid contained in the guide channel, wherein the guide channel defines a loop-shaped ride path; and a chain of passenger boats floating in the liquid of the guide channel, wherein each of the boats is linked with a connecting link at a first side to a leading one of the boats and with a connecting link at an opposite second side to a trailing one of the boats such that the chain of boats is continuous, and further wherein the chain of boats has a length that is approximately equal to a length of the loop-shaped ride path and all of the boats in the chain move along the loop-shaped ride path at a predefined rate, wherein the sidewalls of the structure further define a free-floating portion in which the sidewalls are spaced apart a distance selected such that the vehicles travel through the free-floating portion free of abutting contact with the sidewalls and wherein the liquid in the free-floating portion moves at a rate less than a rate at which the liquid moves in the guide channel.

2. The boat ride of claim 1, further comprising a propulsion system connected to the guide channel, wherein the propulsion system operates to move at least a portion of the liquid in the guide channel at one or more flow rates, whereby the chain of boats moves along the loop-shaped ride path at the predefined rate that is selected from a range of 1 to 4 feet per second.

3. The boat ride of claim 2, wherein the guide channel has a width as measured between inner surfaces of the sidewalls that is greater than a width of each of the boats by less than a preset magnitude selected from the range of zero to a maximum one of the widths of the boats.

4. The boat ride of claim 1, wherein the connecting links provide direct boat-to-boat connections that each include at least one pivot point providing freedom of movement in at least two directions.

5. The boat ride of claim 1, wherein free-rolling or powered guide wheels are provided on inner surfaces of the sidewalls in the guide channel or are provided on sides of each of the vehicles to reduce friction when the vehicles are guided to travel along the loop-shaped ride path by the sidewalls.

6. The boat ride of claim 1, wherein the structure includes at least one section in which the boats in the chain of boats travel out of the liquid and back into the liquid, the boats in the section being moved along the loop-shaped ride path by the boats in the liquid of the guide channel.

7. A boat ride with high capacity and enhanced spacing control of floating passenger boats, comprising:

a structure with spaced apart sidewalls defining an elongated guide channel;

a volume of liquid contained in the guide channel, wherein the guide channel defines a loop-shaped ride path; and a chain of passenger boats floating in the liquid of the guide channel, wherein each of the boats is linked with a connecting link at a first side to a leading one of the boats and with a connecting link at an opposite second side to a trailing one of the boats such that the chain of boats is continuous, and further wherein the chain of boats has a length that is approximately equal to a length of the loop-shaped ride path and all of the boats in the chain move along the loop-shaped ride path at a predefined rate;

a propulsion system connected to the guide channel, wherein the propulsion system operates to move at least a portion of the liquid in the guide channel at one or more flow rates, whereby the chain of boats moves along the loop-shaped ride path at the predefined rate that is selected from a range of 1 to 4 feet per second; and a wave generator along a section of the guide channel, the wave generator operating to form waves on a surface of the liquid in the guide channel section.

8. The boat ride of claim 7, wherein the connecting links comprise at least one of a ball coupler, a rigid tow bar, and a flexible tow bar.

9. A floating omnimover ride system, comprising:

a channel defining a ride path and containing a volume of water;

a plurality of passenger vehicles adapted for floating positioned in the water of the channel, each of the vehicles linked to an adjacent pair of the vehicles via connecting links such that the vehicles are linked together in a continuous chain;

a pumping system moving the water in the channel, wherein the chain of the vehicles is moved at a substantially constant speed along the length of the ride path, wherein the pumping system operates to move at least a portion of the water in the channel at one or more flow rates, whereby the continuous chain of boats moves along the ride path at the substantially constant speed within a range of 1 to 4 feet per second, and wherein the ride system further includes a wave generator along a section of the channel, the wave generator operating to form waves on a surface of the water in the channel.

10. The ride system of claim 9, wherein each of the connecting links is a compliant element allowing independent roll, pitch, and yaw movement of adjacent ones of the vehicles.

11. The ride system of claim 10, wherein the chain of the vehicles has a length substantially equal to the length of the ride path.

12. The ride system of claim 9, wherein the constant speed is within the range of 1 to 4 feet per second.

13. The ride system of claim 9, wherein the channel includes sidewalls providing a lagoon in which the vehicles are spaced apart from the sidewall and providing a vehicle drive portion with guiding surfaces intermittently contacting the vehicles to guide the vehicles to travel along the ride path and wherein the pumping system only moves the water in the vehicle drive portion.

14. The rides system of claim 9, further including a station with load and unload conveyor belts extending along the channel and further including a stabilizer assembly contacting the vehicles when adjacent the load and the unload conveyor belts to stabilize movement of the vehicles in the water to at least prevent side-to-side movement within the channel.

15. An amusement park ride, comprising:

a plurality of boats for carrying passengers, wherein the boats are interconnected with boat-to-boat connecting links in a continuous manner to form a loop;

a channel for receiving water and the boats, the boats floating on a surface of the received water; and a propulsion assembly for propelling all of the boats at a velocity in the range of 1 to 4 feet per second by causing the received water to flow within a guide section in which the boats are guided to travel along the channel via abutting contact, wherein the channel includes a free-floating portion with an inlet and an outlet connected with the guide section, the boats being moved from the inlet to the outlet by forces applied along the loop by the boats in the guide section and wherein the received water in the free-floating portion moves at a rate less than a rate at which the received water moves in the guide section.

16. The amusement park ride of claim 15, wherein the connecting links each comprise at least one pivot point providing independent movements of the boats in the received water.

17. The amusement park ride of claim 16, wherein the connecting links each comprise a rigid tow bar with a length setting a minimum separation distance between adjacent ones of the boats, whereby the adjacent ones of the boats are maintained in a spaced-apart configuration in the loop.

18. An amusement park ride, comprising:

a plurality of boats for carrying passengers, wherein the boats are interconnected with boat-to-boat connecting links in a continuous manner to faun a loop;

a channel for receiving water and the boats, the boats floating on a surface of the received water; and a propulsion assembly for propelling all of the boats at a velocity in the range of 1 to 4 feet per second by causing the received water to flow within a guide section in which the boats are guided to travel along the channel via abutting contact, wherein the channel includes a free-floating portion with an inlet and an outlet connected with the guide section, the boats being moved from the inlet to the outlet by forces applied along the loop by the boats in the guide section and wherein the channel has two or more elevations connected by inclined and declined ramps and further including a wave generator along a wave section of the channel to create waves on the surface of the received water in the wave section to induce motion in the vehicles passing through the wave section.

* * * * *

UNITED STATES PATENT AND TRADEMARK OFFICE

CERTIFICATE OF CORRECTION

PATENT NO. : 8,375,864 B1
APPLICATION NO. : 13/193746
DATED : February 19, 2013
INVENTOR(S) : David W. Crawford and Edward A. Nemeth It is certified that error appears in the above-identified patent and that said Letters Patent is hereby corrected as shown below:

In the Claims:

Column 16, Lines 17-39, please replace claim 18 with the following rewritten claim -- An amusement park ride, comprising:
a plurality of boats for carrying passengers, wherein the boats are interconnected with boat-to-boat connecting links in a continuous manner to form a loop;
a channel for receiving water and the boats, the boats floating on a surface of the received water; and
a propulsion assembly for propelling all of the boats at a velocity in the range of 1 to 4 feet per second by causing the received water to flow within a guide section in which the boats are guided to travel along the channel via abutting contact,
wherein the channel includes a free-floating portion with an inlet and an outlet connected with the guide section, the boats being moved from the inlet to the outlet by forces applied along the loop by the boats in the guide section and
wherein the channel has two or more elevations connected by inclined and declined ramps and further including a wave generator along a wave section of the channel to create waves on the surface of the received water in the wave section to induce motion in the vehicles passing through the wave section. --

Signed and Sealed this
Fourteenth Day of May, 2013

Teresa Stanek Rea
*Acting Director of the United States Patent and Trademark Office*